US006615799B2

(12) United States Patent
Mori et al.

(10) Patent No.: US 6,615,799 B2
(45) Date of Patent: Sep. 9, 2003

(54) FUEL INJECTION PUMP

(75) Inventors: Katsumi Mori, Chiryu (JP); Katsunori Furuta, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/059,009

(22) Filed: Jan. 30, 2002

(65) Prior Publication Data

US 2002/0104514 A1 Aug. 8, 2002

(30) Foreign Application Priority Data

Feb. 7, 2001 (JP) ..... 2001-031255
Jan. 18, 2002 (JP) ..... 2002-009956

(51) Int. Cl.[7] ..... F04B 7/00; F02M 41/00
(52) U.S. Cl. ..... 123/450; 417/273
(58) Field of Search ..... 123/450, 495; 417/273, 420

(56) References Cited

U.S. PATENT DOCUMENTS 2,657,634 A * 11/1953 Greenland et al. ..... 417/273
3,682,572 A * 8/1972 Yarger ..... 417/273
5,833,438 A * 11/1998 Sundberg ..... 417/208
5,876,186 A * 3/1999 Stiefel ..... 417/273
6,345,609 B1 * 2/2002 Djordjevic ..... 123/509

* cited by examiner

*Primary Examiner*—Thomas N. Moulis
(74) *Attorney, Agent, or Firm*—Nixon & Vanderhye P.C.

(57) ABSTRACT

A camshaft has a cam having a circular profile. A cam-ring is rotatably arranged on a radial outside of the cam. The cam-ring orbits around the cam. The cam-ring has a metal bush on an inner surface thereon. The cam-ring rotates relative to the cam, but is prevented from a rotation itself. The cam has a groove inclined with respect to a rotating axis of the cam. The groove has openings on both axial ends of the cam. The groove introduces fuel as a lubricant into a gap between the cam and the metal bush. The fuel introduced into the gap improves a lubricity and prevents a sticking.

4 Claims, 4 Drawing Sheets

FUEL INJECTION PUMP

CROSS REFERENCE TO RELATED APPLICATION

This application is based on Japanese Patent Application No. 2001-31255 filed on Feb. 7, 2001, and Japanese Patent Application No. 2002-9956 filed on Jan. 18, 2002 the contents of which are incorporated herein by reference.

BACKGROUND OF THE INVENTION

1. Field of the Invention

The invention relates to a fuel injection pump for an internal combustion engine for a vehicle.

2. Description of Related Art

Conventionally, a fuel injection pump that has an eccentric cam and a cam-ring is known in the art. The cam-ring orbits around a rotating axis or a center axis of the camshaft and drives plungers reciprocally to pressurize fuel in a pressurizing chamber.

The cam-ring has a metal bush for preventing the cam from a sticking. However, it is necessary to select material of the metal bush to improve an anti-sticking performance. It is also effective to improve the anti-sticking performance by enlarging a surface of the metal bush to dissipate a surface pressure.

However, utilizing a high-performance material increases the costs of the apparatus. The large metal bush is also expensive and makes it difficult to reduce the size of the pump.

SUMMARY OF THE INVENTION

It is an object of the present invention to provide a fuel injection pump being capable of reducing an abrasion and reducing possibilities of a sticking.

It is further object of the present invention to provide a fuel injection pump being capable of improving a lubricity.

According to a first aspect of the present invention, the cam has a concave portion on an outer surface of the cam. The concave portion introduces a lubricant into a gap between the cam and the cam-ring. The concave portion is formed on a region where a force caused by pressurizing fuel is not applied. The cam pushes the cam-ring by an outer surface on a region where a distance between the rotating axis of the cam and an outer profile increases. The region where the force caused by pressurizing fuel is not applied is generally located on a slightly retard side from a region where the distance between the rotating axis and the outer profile decreases. Even in the case that the cam drives a plurality of plungers, the cam has the region where the force caused by pressurizing fuel is not applied. The concave portion introduces fuel to improve the lubricity. Even if the concave portion has an edge, since the force doesn't concentrate on the edge, it is possible to reduce an abrasion.

The concave portion may be a groove extending over an axial direction of the cam from an axial end of the cam to the other axial end of the cam. This arrangement may introduce more lubricant.

The groove may not be in parallel with a rotating axis of the cam. This arrangement may increase lubricant flow in the groove.

The concave portion may be formed on a region from a top dead center to a bottom dead center in a rotating direction.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Hereinafter, an embodiment of the present invention will be explained with reference to drawings.

Figure 1:
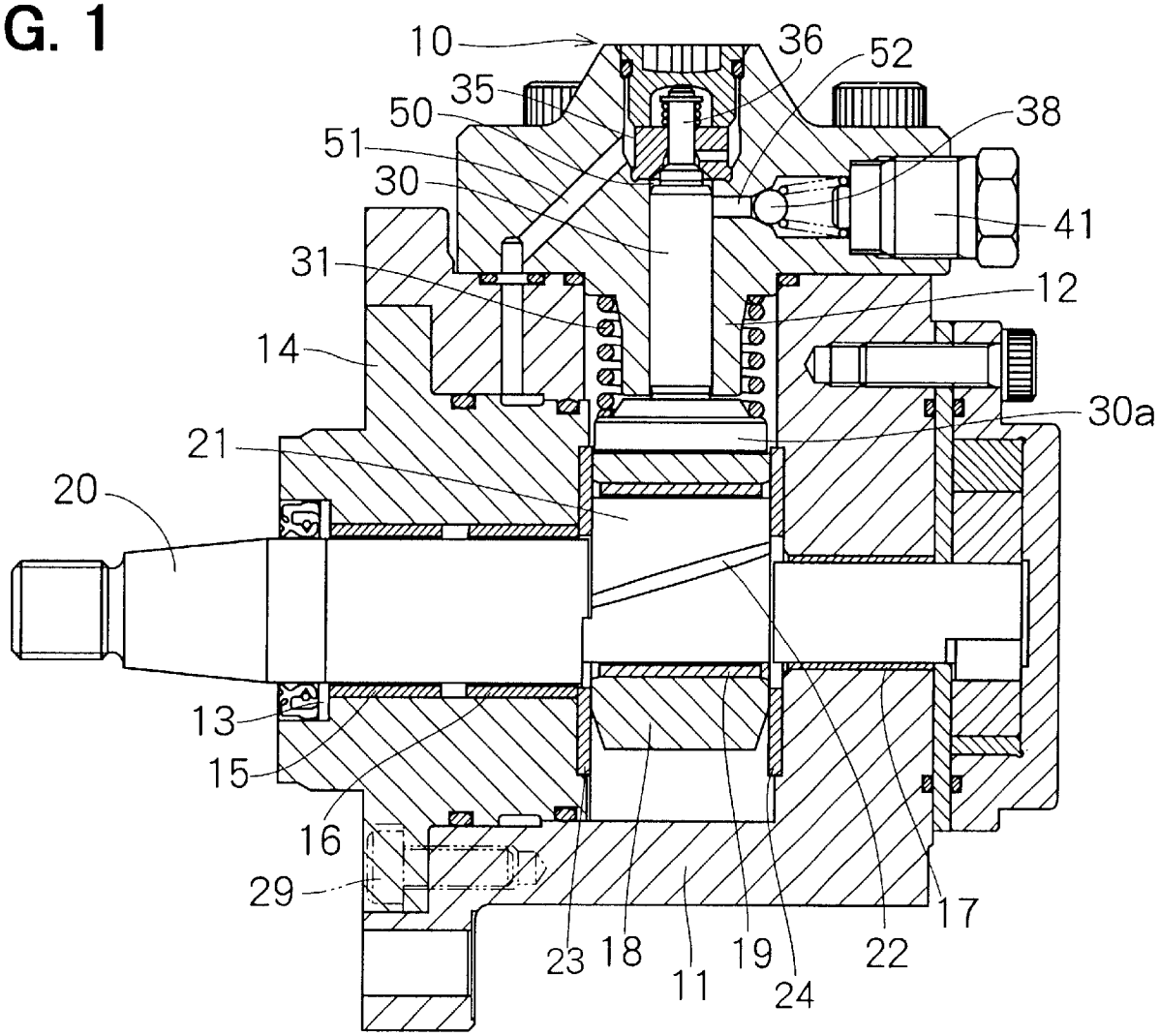
FIG. 1 is a longitudinal cross sectional view of a fuel injection pump according to an embodiment of the present invention.
Figure 2:
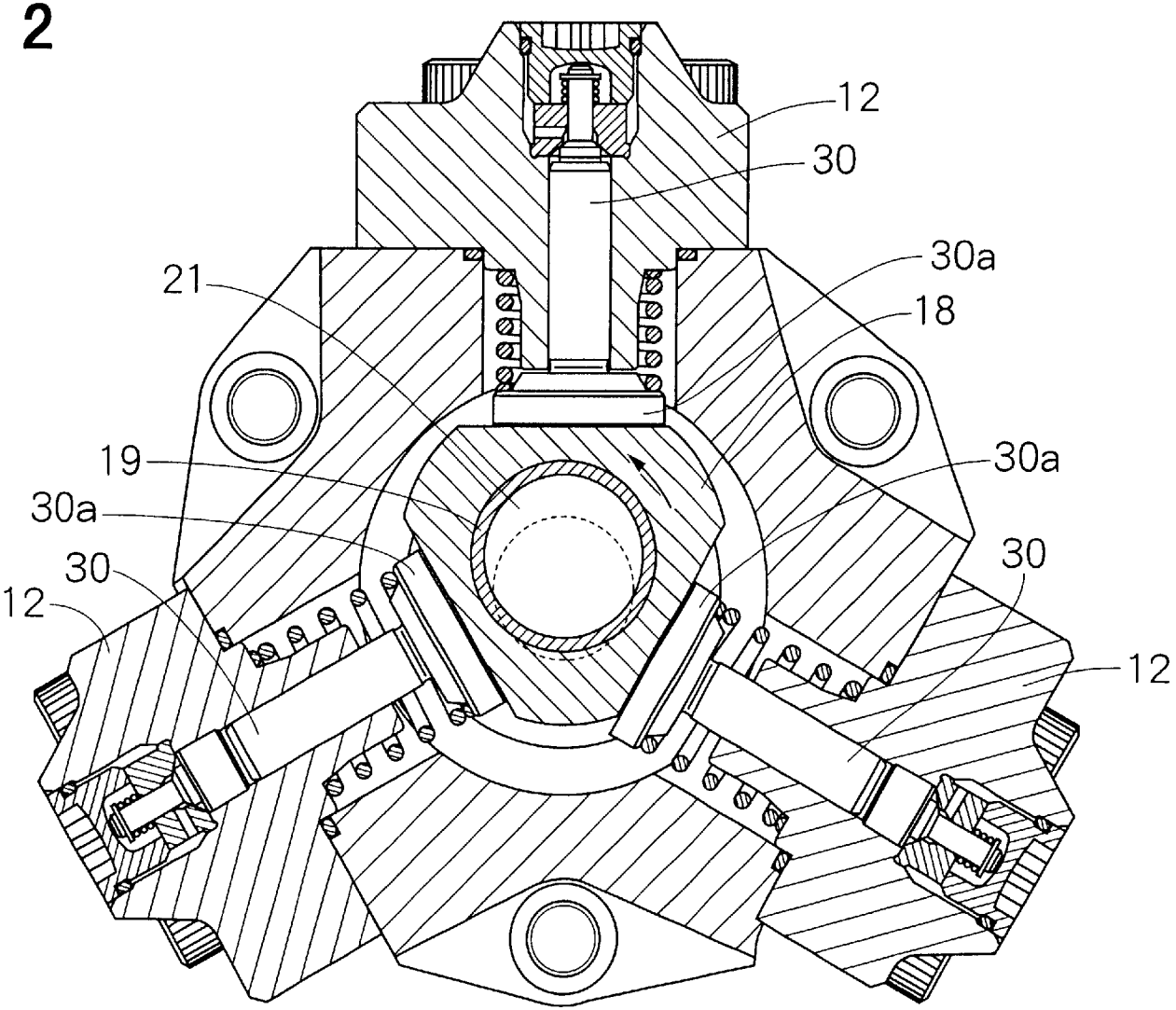
FIG. 2 is a transverse cross sectional view of the fuel injection pump according to the embodiment of the present invention.
Figure 3:
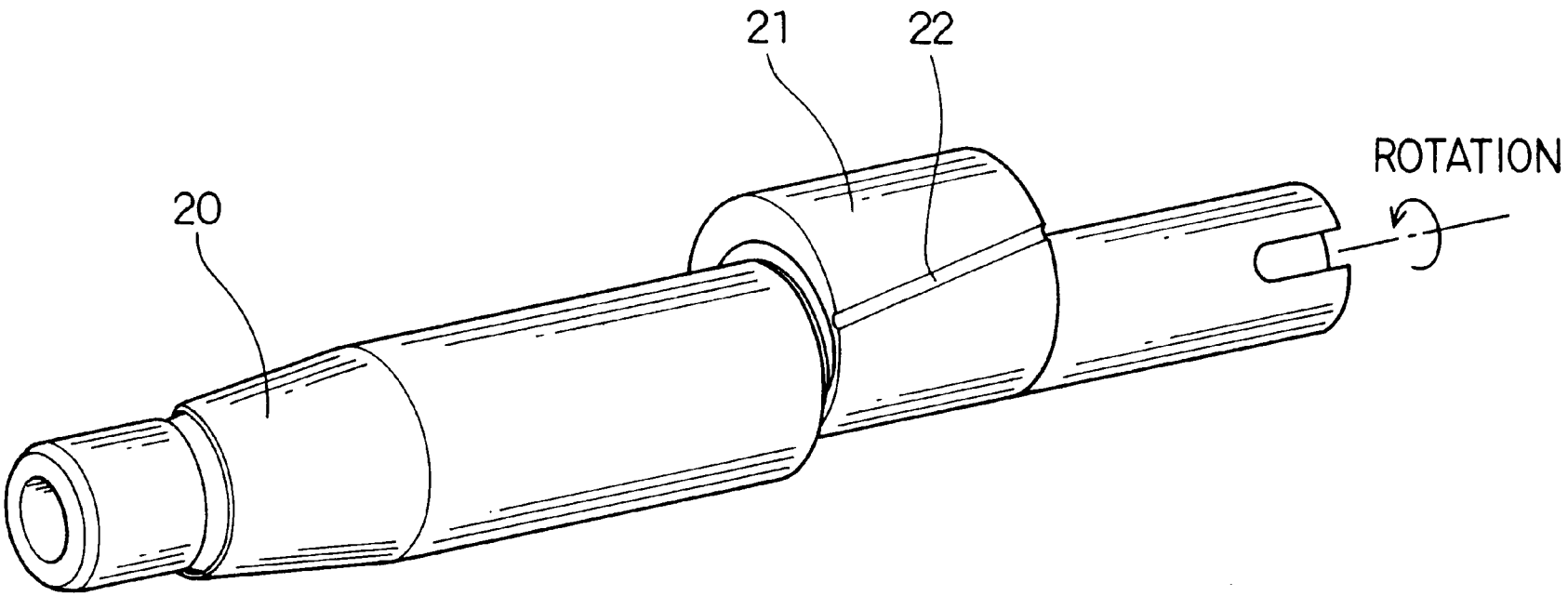
FIG. 3 is a perspective view of a camshaft according to the embodiment of the present invention.

FIGS. 1 and 2 show a fuel injection pump according to an embodiment of the present invention. FIG. 3 shows perspective view of a camshaft of the fuel injection pump. The fuel injection pump 10 has three cylinders arranged by 120° intervals. Each cylinder has a plunger 30 located on radial outside of a camshaft 20. FIG. 1 shows an arrangement of the fuel injection pump 10 in a direction viewing a longitudinal cross section of one of the plunger 30.

The fuel injection pump 10 has a pump housing. The pump housing has a housing body 11 that is common for three cylinders. Each cylinder has a cylinder head 12. Further, the pump housing has a bearing cover 14 and the like. The cylinder head 12 supports a plunger 30 reciprocally driven as a movable member. An inner surface of the cylinder head 12 defines a pressuring chamber 50 with an end surface of a one-way valve member 36 of a one-way valve 35 and an end surface of the plunger 30.

The bearing cover 14 is fixed on the housing body 11 by bolts 29. The bearing cover 14 supports metal bushes 15 and 16 as bearings for the camshaft 20. The housing body 11 supports a metal bush 17 as the other one of the bearings for the camshaft 20. The bearing cover 14 has an oil seal 13 for sealing between the bearing cover 14 and the camshaft 20. Therefore, the housing defines a chamber accommodating the cam. The chamber is filled with fuel introduced through each cylinder.

The camshaft 20 is housed in the housing body 11 and the bearing cover 14, and is rotatably supported by the metal bushes 15, 16 and 17. Referring to FIG. 2, a cam 21 is arranged to rotate with the camshaft 20 and is eccentric with a rotating axis of the camshaft 20. The cam 20 has a circular profile. The cam 20 may be formed separately with the camshaft and assembled as shown in FIG. 2. Axial inner surfaces of the housing body 11 and the bearing cover 14 respectively supports ring like thrust plates 23 and 24, which are slidingly contact with axial end surfaces of the cam 21. The plungers 30 are disposed on a radial outside of the camshaft 20 by 120° intervals each other. A cam-ring 18 is disposed on a radial outside of the cam 21. The cam-ring 18 has a specific hexagonal outer profile composed of flat surfaces and circular surfaces, and a circular inner profile.

The inner profile of the cam-ring 18 supports a ring-shaped metal bush 19, which is slidingly contact with the cam 21. The metal bush 19 is press fitted on the inner profile of the cam-ring 18 for forming a part of the cam-ring. Part of the outer profile of the cam-ring 18 facing to the plunger 30 and an end surface of the plunger head 30*a* are formed as flat surfaces and are contact with each other. It is possible to decrease a surface pressure on the cam-ring 18 and the plunger 30 because both of the contacting surfaces of the cam-ring 18 and plunger 30 are formed into flat shape.

According to an arrangement described above, the cam-ring 18 orbits around the rotating axis of the camshaft 20 as the cam 21 rotates. An orbital motion of the cam-ring 18 is defined by an eccentric distance of the cam 21 from the rotating axis of the camshaft 20. Although the cam 21 rotates itself, the cam-ring 18 slides on the cam 21. Since the cam-ring 18 is held in a rotating direction by the plungers 30, the cam-ring 18 doesn't rotate itself.

Each of the plungers 30 is pushed toward the cam-ring 18 by a spring 31. Therefore, the plunger 30 radially moves to alternately increase and decrease volume of the pressurizing chamber 50 as the cam-ring 18 orbits. The plunger 30 introduces fuel from a fuel inlet passage 51 through a one-way valve 35 during an increasing phase, and pressurizes fuel in the pressurizing chamber 50. The one-way valve 35 prevents return flow from the pressurizing chamber 50 to the fuel inlet passage 51.

Connectors 41 are connected with the cylinder heads 12 respectively. Each pair of the cylinder head 12 and the connector 41 forms a fuel outlet passage 52. In each of the fuel outlet passages 52, a one-way valve that has a one-way valve member 38 is disposed. The one-way valve prevents fuel return flow from the fuel outlet passage 52 to the pressurizing chamber 50. The pressurized fuel is supplied to a common rail through the connector 41 and appropriate pipes.

A sliding relationship between the cam 21 and the metal bush 19 will be explained. The cam 21 and the metal bush 19 are assembled to be slidable. To ensure a lubrication therebetween, according to the embodiment, a groove 22 is formed on an outer surface of the cam 21 as shown in FIGS. 1 and 3. The groove 22 is a concave portion formed on the outer surface of the cam 21. The housing body 11 and the bearing cover 14 define a cavity filled with fuel that works as a lubricant. The cam 21 and the other parts are submerged in fuel in the cavity. Therefore, the groove 22 is filled with fuel and supplies fuel for forming a fuel layer between the outer surface of the cam 21 and an inner surface of the metal bush 19. The fuel layer ensures the lubrication between the cam 18 and the metal bush 19.

The groove 22 has an opening on a one axial end of the cam 21 and an opening on the other axial end of the cam 21. The groove 21 connects both axial end of the cam 21. Fuel may flow through the groove 22 to improve the lubricity and to remove a particle such as metal particles or the like. Further, the groove 22 is not parallel with the rotating axis of the cam 21. It is possible to improve the lubricity by increasing a fuel amount flowing through the groove 22, since the fuel in the groove 22 may be forcedly flowed by an inertial force generated by a deviation of a rotating speed of the cam 21. The groove 22 may be parallel with the rotating axis of the cam 21. A cross-sectional area of the groove 22 is defined to ensure the lubricity in accordance with the needs. Only one groove 22 is enough if the cross-sectional area is designed properly, but a plurality of grooves having smaller cross-sectional areas may be utilized instead of the groove 22.

Figure 4:
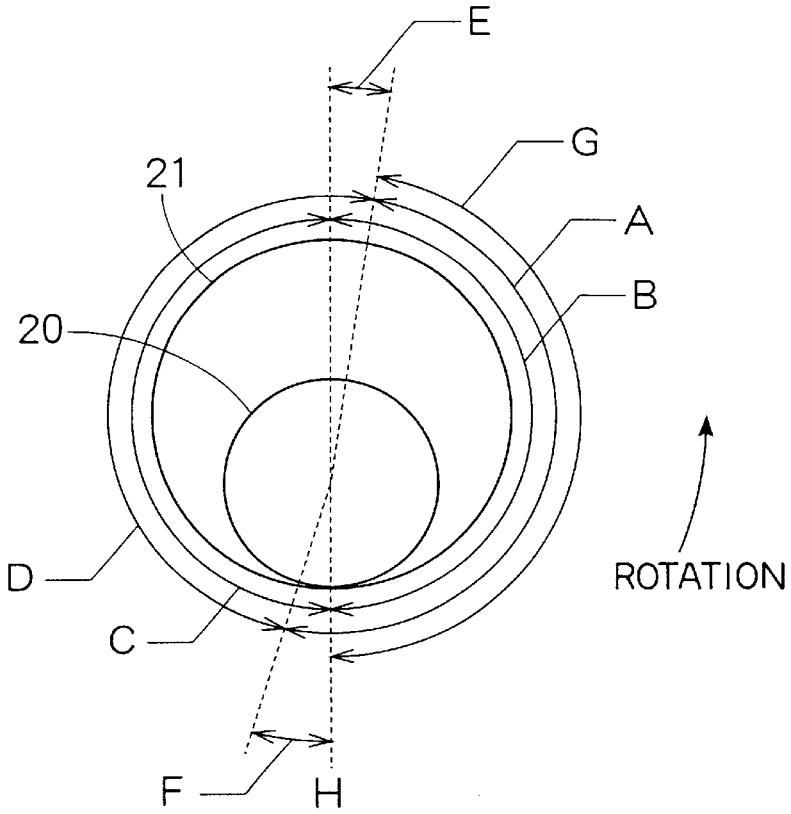
FIG. 4 is a front view of the camshaft and a cam according to the embodiment of the present invention.
Figure 5:
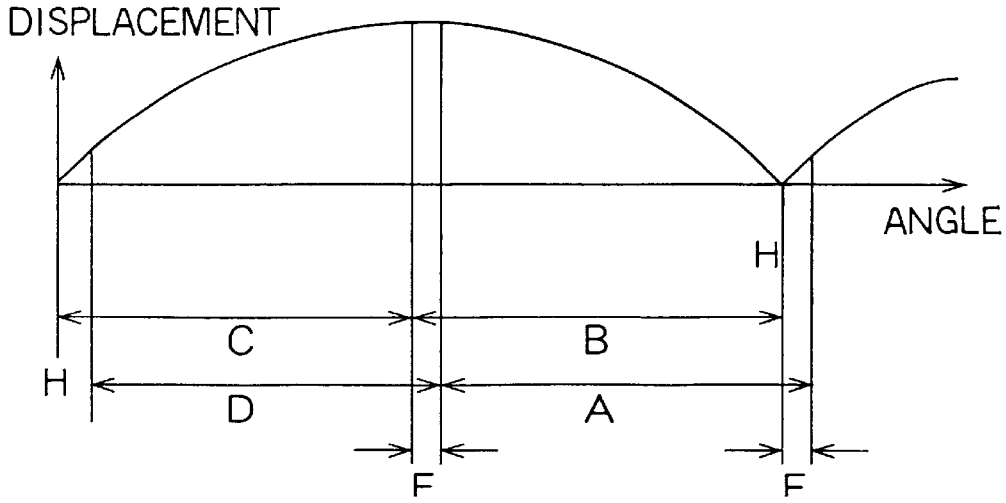
FIG. 5 is a graph showing a relationship between an rotating angle of the cam and a displacement of a plunger according to the embodiment of the present invention.

The groove 22 needs sharp edges on both sides. Therefore, the groove 22 is formed on a specific region to maintain the lubricity between the cam 21 and the bush 19 on the edges. The groove 22 is formed on a region of the outer surface of the cam 21 where the cam 21 receives a relatively low pressure from the metal bush 19. It is also effective to form the groove inconspicuous by forming the edges into round corners or the like. FIG. 4 is a graph for explaining a pressure from the metal bush 19 on each region A through F of the outer surface of the cam 21. FIG. 5 is a graph showing a relationship between the pressure applied from the metal bush 19 to the cam 18, rotating angle of the cam 21 and a displacement of the plunger 30 with respect to one of the plungers 30. The cam 21 pushes the cam-ring 18 and the plunger 30 up when the plunger 30 is placed on a region C. The plunger 30 moves down following the cam-ring 18, when the plunger 30 is in a region B. The cam 18 receives higher pressure when the plunger 30 is in a region D than when the plunger 30 is in a region A by a fuel pressure in the pressurizing chamber 50. The region D is on a retard side to the region C, and the region A is also on a retard side to the region B, because fuel cannot pressurize at a beginning of a forward stroke of the plunger 30 by a delay of the one-way valve 35 or the like, and a fuel pressure in the pressurizing chamber 50 is still not lowered enough at a beginning of a backward stroke.

In this embodiment, a region where force caused by pressurizing fuel is not applied means the region A. Since the cam 21 receives the pressure from the metal bush 19 unevenly on the region A, the groove 22 is formed on an approximately center of a region G. The groove 22 is formed on the cam 21 with an inclination with respect to the rotating axis of the cam 21. The groove 22 is located on a region from 270° to 290° in a retard side from a reference point that is a most advance point of the region C indicated by H in FIG. 3. The groove 22 is formed on a region from a top dead center to a bottom dead center in a rotating direction. The groove 22 may be formed in parallel with the rotating axis of the cam 21.

An operation of the fuel injection pump 10 will be explained.

The cam 21 rotates as the camshaft 20 rotates. The cam-ring 18 orbits as the cam 21 rotates. The plungers 30 respectively reciprocate by following the orbital motion of the cam-ring 18. Fuel is supplied from a supply pump (not shown) to the fuel inlet passage 51 through a metering valve (not shown.) When one of the plungers 30 in a top dead center moves downwardly as the cam-ring 18 orbits, fuel metered by the metering valve is introduced into the pressurizing chamber 50 through the one-way valve 35. When the plunger 30 moves upwardly toward the top dead center after reaching a bottom dead center, the one-way valve 35 is closed, and the fuel in the pressurizing chamber is pressurized. When a fuel pressure in the pressurizing chamber 50 reaches higher than a fuel pressure in a downstream side of the one-way valve member 38, the one-way valve 38 opens to communicate the pressurizing chamber 50 and the common rail. Each of the cylinder has the one-way valve member 38 respectively, therefore the one-way valve members alternately opens respective passages. The fuel supplied to the common rail through the passages and the connectors 41 is accumulated in the common rail and maintained at a constant pressure. Then, the fuel is supplied from the common rail to injectors (not shown.)

In this embodiment, the groove 22 formed on the cam 21 is formed over an entire axial direction of the cam 21 from the one end of the cam 21 in the rotating axis direction to the other end of the cam 21 in the rotating axis direction. Therefore, the groove 22 opens to the both end of the cam 21 in the rotating direction. According to the arrangement described above, it is possible to introduce fuel into the groove 22 from the ends of the cam 21 in the rotating axis direction. The fuel in the groove 22 flows into a gap between the inner surface of the metal bush 19 and the inner surface of the cam 21, and forms a fuel layer. Since the fuel acts as a lubricant, the lubricity between the metal bush 19 and the cam 21 is improved. As a result, it is possible to reduce a stick of the metal bush 19 on the cam 21, and reduce an abrasion of the metal bush 19 and the cam 21 caused by a relative rotation of the cam 21 and the cam-ring 18.

It is possible to fill the groove 22 with fuel and change the fuel by opening the groove 22 on the both axial ends of the cam 21. Therefore, it is possible to discharge sludge formed by an abrasion of the metal bush 19 and the cam-ring 18 and prevent a sludge deposition.

In this embodiment, the groove 22 is formed as an inclined groove that is not in parallel with the rotating axis of the cam 21. It is possible to flow the fuel in the groove 22 forcedly, and improve the lubricity.

The camshaft 20 may has grooves on outer surfaces facing the metal bushes 15, 16 and 17. These grooves supply fuel in gaps between the camshaft 20 and the metal bushes 15, 16 and 17, and form fuel layer therein. It is possible to improve lubricities between the camshaft 20 and the metal bushes 15, 16 and 17.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel injection pump, comprising:

a camshaft having a cam thereon;

a cam-ring rotatably arranged on a radial outside of the cam and orbiting a rotating axis of the camshaft;

a housing defining a fuel pressurizing chamber and housing the cam;

a plunger which reciprocates by following an orbital motion of the cam-ring and pressurizes fuel introduced into the fuel pressurizing chamber, wherein an outer surface of the cam defines a concave portion for introducing a lubricant into a gap between the cam and the cam-ring, the concave portion being formed on a region where a force caused by pressurizing fuel is not applied.

2. The fuel injection pump according to claim 1, wherein the concave portion is a groove extending over an axial direction of the cam from an axial end of the cam to the other axial end of the cam.

3. The fuel injection pump according to claim 2, wherein an extending direction of the groove is not parallel with a rotating axis of the cam.

4. The fuel injection pump according to claim 1, wherein the concave portion is formed on a region from a top dead center to a bottom dead center in a rotating direction.

* * * * *

UNITED STATES PATENT AND TRADEMARK OFFICE

CERTIFICATE OF CORRECTION

PATENT NO. : 6,615,799 B2
DATED : September 9, 2003
INVENTOR(S) : Mori et al.

It is certified that error appears in the above-identified patent and that said Letters Patent is hereby corrected as shown below:

Title page,
Item [*], should read as follows:

-- [*] Notice: Subject to any disclaimer, the term of this patent is extended or adjusted under 35 U.S.C. § 154(b) by 61 days. --

Signed and Sealed this

Twenty-third Day of December, 2003

JAMES E. ROGAN
*Director of the United States Patent and Trademark Office*